United States Patent [19]

Miyata et al.

[11] Patent Number: 5,001,438

[45] Date of Patent: Mar. 19, 1991

[54] CHARGED PARTICLE ACCELERATOR AND METHOD OF COOLING CHARGED PARTICLE BEAM

[75] Inventors: Kenji Miyata, Katsuta; Yoshiya Higuchi, Hitachi; Masatsugu Nishi, Katsuta, all of Japan

[73] Assignee: Hitachi, Ltd., Tokyo, Japan

[21] Appl. No.: 397,431

[22] PCT Filed: Dec. 5, 1988

[86] PCT No.: PCT/JP88/01225

§ 371 Date: Aug. 7, 1989

§ 102(e) Date: Aug. 7, 1989

[87] PCT Pub. No.: WO89/05565

PCT Pub. Date: Jun. 15, 1989

[30] Foreign Application Priority Data

Dec. 7, 1987 [JP] Japan ..... 62-307550

[51] Int. Cl.[5] ..... H05H 13/04

[52] U.S. Cl. ..... 328/235; 328/237; 328/228; 313/11

[58] Field of Search ..... 328/233, 235, 237, 228

[56] References Cited

U.S. PATENT DOCUMENTS 4,780,683 10/1988 Nakata ..... 328/235

FOREIGN PATENT DOCUMENTS 22400 1/1987 Japan .
147641 7/1987 Japan .
287600 12/1987 Japan .

*Primary Examiner*—Kenneth Wieder
*Attorney, Agent, or Firm*—Antonelli, Terry, Stout & Kraus

[57] ABSTRACT

A new cavity which is separate from a rf (radio frequency) accelerating cavity is provided on the orbit of charged particles in a ring-shaped accelerator, and an external oscillator and a coupled antenna which serve to excite a rf electromagnetic field in the separate cavity are provided. Using the external oscillator and the coupled antenna, a deflection mode which has electric field components in the direction of the central orbit of the charged particles and in which a magnetic field in a direction perpendicular to the plane of the central orbit develops on the central orbit of the charged particles is excited in a beam duct part of the separate cavity through which the charged particles pass. The resonant frequency of the deflection mode is set at integral times that of a fundamental rf mode in the rf accelerating cavity, and the phase relationship between the rf fields of the rf accelerating cavity and the separate cavity is so held that, when the rf electric field intensity of the rf accelerating cavity has a phase of zero, the rf magnetic field intensity of the separate cavity rises in phase.

5 Claims, 7 Drawing Sheets

PHASIC RELATIONSHIP BETWEEN rf ELECTRIC FIELD INTENSITY AND rf MAGNETIC FIELD INTENSITY (FOR m=4)

CHARGED PARTICLE ACCELERATOR AND METHOD OF COOLING CHARGED PARTICLE BEAM

TECHNICAL FIELD

The present invention relates to a ring-shaped accelerator for accelerating charged particles and a method of cooling a charged particle beam, and more particularly to an accelerator which is well suited to enter a particle beam of large current at low energy and then accelerate it to high energy and to store the high-energy particle beam.

BACKGROUND ART

A diagram of the whole accelerator system is shown in FIG. 2. This apparatus is constructed of an entrance device 3 which enters charged particles, and a ring-shaped accelerator 50 which accelerates and stores the particles. Used as the injector 3 is a linac, a synchrotron, a microtron or the like. The ring-shaped accelerator 50 includes a beam duct 7 which forms a vacuum vessel for confining a particle beam 2, bending magnets 5 which deflect the orbit 10 of the particle beam 2, quadrupole magnets 6 which endow the particle beam with a focusing function, and a rf (radio frequency) accelerating cavity 4 which accelerates the particles.

For industrializing such an apparatus, it has become an important theme to reduce the size of the apparatus and yet to permit the storage of a large current. As one idea therefor, there is a proposal in which particles are entered at a low energy level below 100 MeV and are accelerated and then stored. Although there is an actual example having realized the proposal, a large current of about 500 mA has not been stored in any example yet. By the way, an apparatus of this type is discussed in, for example, "Institute of Physics, Conference Series No. 82, p. 80–84 (Cambridge, 8–11 Sept. 1986)".

In the ring-shaped accelerator, the particles circulate while betatron-oscillating round a closed orbit corresponding to the energy of the particles. Besides, as shown in FIG. 3, the bunch of particles to be accelerated have as their central orbit a closed orbit 20 which corresponds to their center energy. In general, a closed orbit 21 corresponding to energy higher than the center energy lies outside the central orbit 20, whereas a closed orbit 22 corresponding to energy lower than the center energy lies inside the central orbit 20. In this manner, the closed orbits of the particles exhibit energy dispersiveness.

On the other hand, in order to accelerate the bunch of particles, at least one rf accelerating cavity is disposed on the orbit of the particles, so that the particles are oscillated also in terms of energy by the acceleration/deceleration mechanism of a rf electric field based on the cavity. This phenomenon is usually called "synchrotron oscillations". The synchrotron oscillations affect the betatron oscillations of the particles on account of the energy dispersiveness of the closed orbit stated above. For this reason, the amplitude of the transverse oscillations of the particles enlarges with the spread of an energy distribution attributed to the synchrotron oscillations.

Thus, the beam widens greatly in the transverse direction thereof The widening gives rise to a transverse wake field (a transient electromagnetic field due to the interaction between the particles and the wall of the vacuum vessel), and the wake field renders the behavior of the particle bunch unstable. Heretofore, this phenomenon has led to the problem that a heavy beam loss arises in the acceleration process of the particles after the injection thereof, so the storage of the large current is impossible.

SUMMARY OF THE INVENTION

An object of the present invention is to make the storage of a large current possible in such a way that the widening of a beam in the transverse direction thereof is lessened to weaken a wake field in the transverse direction and to restrain the beam from becoming unstable, thereby to reduce a beam loss.

In the present invention, in order to accomplish the above object, a new cavity which is separate from a rf (radio frequency) accelerating cavity is provided on the orbit of charged particles in a ring-shaped accelerator, while an external oscillator and a coupled antenna which serve to excite a rf electromagnetic field in the separate cavity are provided; using the separate cavity, the external oscillator and the coupled antenna, a deflection mode which has electric field components in the direction of the central orbit of the particles and in which a magnetic field in a direction perpendicular to the plane of the central orbit develops on the central orbit of the particles is excited in a beam duct part of the separate cavity through which the particles pass; the resonant frequency of the deflection mode is set at integral times that of a fundamental rf mode in the rf accelerating cavity; and the phase relationship between the rf fields of the rf accelerating cavity and the separate cavity is so held that, when the rf electric field intensity of the rf accelerating cavity has a phase of zero, the rf magnetic field intensity of the separate cavity rises in phase.

According to the present invention, the charged particles induce an intense synchro-betatron resonance, and the widening of a charged particle beam in the transverse direction thereof lessens Even in case of low-energy injection, accordingly, the beam can be restrained from becoming unstable, and its loss can be reduced, so that the ring-shaped accelerator is permitted to accelerate and store a large current.

DETAILED DESCRIPTION OF PREFERRED EMBODIMENTS

First of all, there will be described a (beam cooling) operation in which the widening of a beam in the transverse direction thereof is lessened by the present invention.

Figure 1:
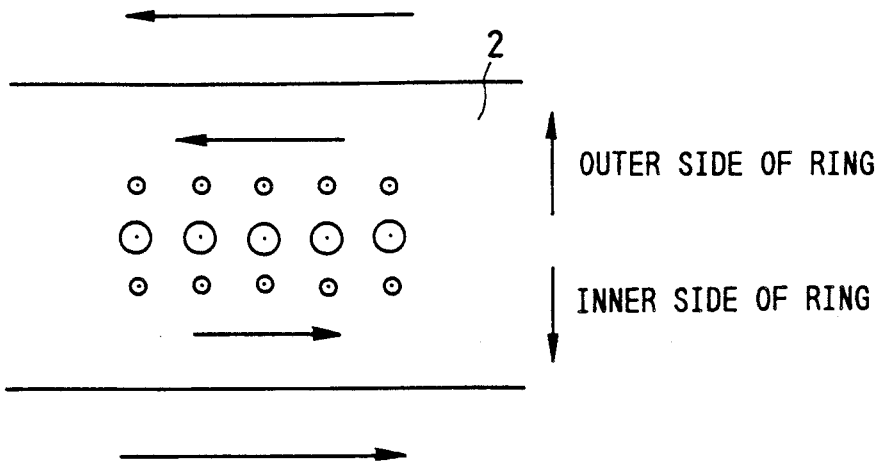
FIG. 1 is a diagram showing the situation of the distribution of electric and magnetic fields in a cavity which serves as the basic element of the present invention.

FIG. 1 illustrates the distribution of electric and magnetic fields in the cavity of the present invention in the case where bunched particles 2 pass inside the cavity When the particle bunch 2 passes inside the cavity, it is affected by the electric and magnetic fields Thus, the amplitude and phase of betatron oscillations being the transverse oscillations of the particles change to incur a fluctuation in the circulating period of the particles. This, in turn, brings about a phase fluctuation in synchrotron oscillations being the oscillations of the particles in the longitudinal direction of the beam. An analyzed examples of the behavior of the particles on this occasion is illustrated in FIG. 4.

Shown in FIG. 4 are variations-with-time in the phase of the synchrotron oscillations of the particles, the energy deviation, the betatron amplitude, and the maximum amplitude of the particles with respect to the central orbit of the particles. The number of circulating turns of the particles is employed as time coordinates on the axis of abscissas. As shown in FIG. 4, minute rf oscillations are supersposed on the sinusoidal curve of the phase of the synchrotron oscillations The frequency of the minute oscillations agrees with a betatron frequency, and this is based on the aforementioned phase fluctuation of the synchrotron oscillations attributed to the betatron oscillations.

On the other hand, low-frequency oscillations at the same frequency as that of the synchrotron oscillations are superposed on the betatron amplitude. This is ascribable to the fact tat, owing to the change of the phase of the synchrotron oscillations, the influence of the electromagnetic field which the particles undergo in the cavity fluctuates just at the period of the synchrotron oscillations.

As stated above, the synchrotron oscillations and betatron oscillations of the particles are intensely coupled by the electromagnetic fields in the cavity. At this time, the particles exhibit an intense synchrobetatron resonance, so that as shown in FIG. 4, the synchrotron oscillations and the betatron oscillations attenuate, and also the maximum amplitude of the oscillations of the particles with reference to the central orbit attenuates.

The synchro-betatron resonance mentioned here is different in nature from a synchro-betatron resonance having heretofore been observed, and a deflection mode is deeply concerned with the phenomenon. Since the synchrotron oscillations and the betatron oscillations relate complicatedly to each other herein, it is difficult to intuitively understand the essence of the phenomenon. It has been revealed, however, that a rf magnetic field in the deflection mode plays an essential role in the phenomenon. Matters close to the fundamentals of the phenomenon will be briefly explained below.

The syncrho-betatron resonance phenomenon is based on the interaction between the synchrotron oscillations and the betatron oscillations. In general, various causes for the interaction are considered, but the following phenomenon is the main cause here:

As the influence which the betatron oscillations exert on the synchrotron oscillations, there is that shift of the circulating period which is ascribable to the betatron oscillations and due to which the phase of the synchrotron oscillations changes Letting the amount of the phase change be $\Delta\theta$, $$\Delta\theta \simeq \frac{2\pi h}{L}(ax_o + b\,y_o) \tag{1}$$

holds. Here, h: harmonic number,

L: circumference, $x_o$: lateral shift from a closed orbit at a certain observation point, $y_o$: $\alpha_o x_o + \beta_o x_o'$, $x_o'$: inclination relative to the closed orbit, of the orbit of particles at the same observation point as that of $x_o$, $$a = \frac{1}{\beta_o}(\eta_o S - \xi_o C)$$

$$b = \frac{1}{\beta_o}(\eta_o C - \xi_o S)$$

$$S = \sin\mu$$

$$C = 1 - \cos\mu$$

$\alpha_o$, $\beta_o$: Twiss parameters at the same observation point as that of $x_o$, $\eta_o$: energy dispersion value at the same observation point as that of $x_o$, $$\xi_o = \alpha_o\eta_o + \beta_o\eta_o'$$

$$\mu = 2\pi\nu (\nu = \text{betatron tune})$$

The observation point in Eq. (1) is set at a position lying directly behind the cavity of the persent invention. Then, $\Delta\theta$ is an evaluation formula for that shift of the phase of the synchrotron oscillations which arises in a path from the observation point to a position lying directly before the cavity of the present invention, and the influence of a rf electric field in a rf accelerating cavity is not contained in the formula Of course, the above influence is taken into consideration in a numerical simulation, but note shall be taken of only the influence of the rf magnetic field in the cavity of the present invention here.

Figure 5:
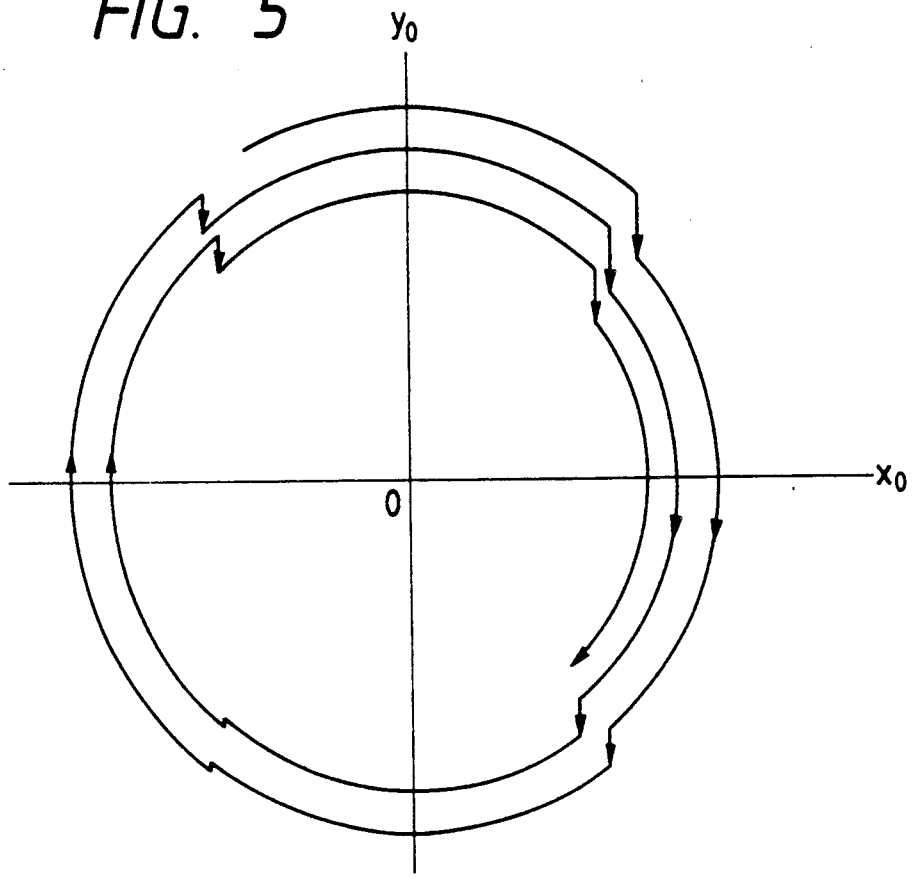
FIG. 5 is a diagram of betatron oscillations showing the basic principle of the present invention.

As indicated by Eq. (1), the shift $\Delta\theta$ of the phase of the synchrotron oscillations relates linearly with $x_o$ and $y_o$. For this reason, when the phase shift is considered on an $x_o - y_o$ plane, the signs of $\Delta\theta$ differ at a point ($x_o$, $y_o$) and a point ($-x_o$, $-y_o$). Therefore, the minute phase oscillations corresponding to the betatron oscillations are superposed on the synchrotron oscillations. Considering that the intensity of the rf magnetic field in the cavity of the present invention changes versus the phase of the synchrotron oscillations, the particles behave on the $x_o - y_o$ plane as depicted in FIG. 5. This figure shows an example in which the fraction of the betatron tune $\nu$ is near 0.25. As illustrated by the figure, the deflection angles of the particles by the rf magnetic field differ at individual points ($x_o$, $y_o$), so that the amounts of changes of $y_o$ differ at the respective points, and this gives rise to the attenuation of the amplitude of the betatron oscillations.

Figure 2:
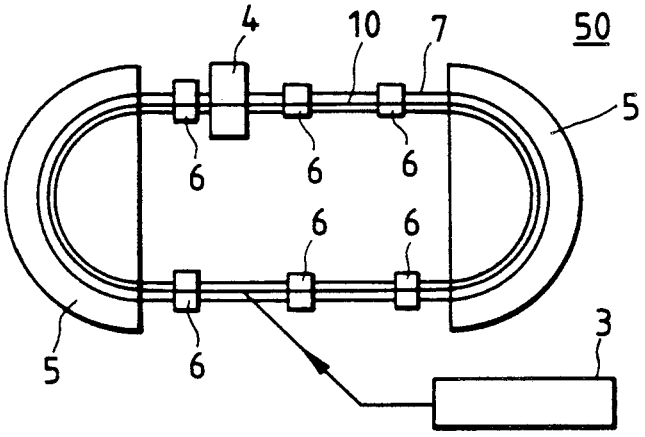
FIG. 2 is an arrangement diagram of the whole accelerator system showing an example of a ring-shaped accelerator to which the present invention is applied.
Figures 6A, 6B, 6C:
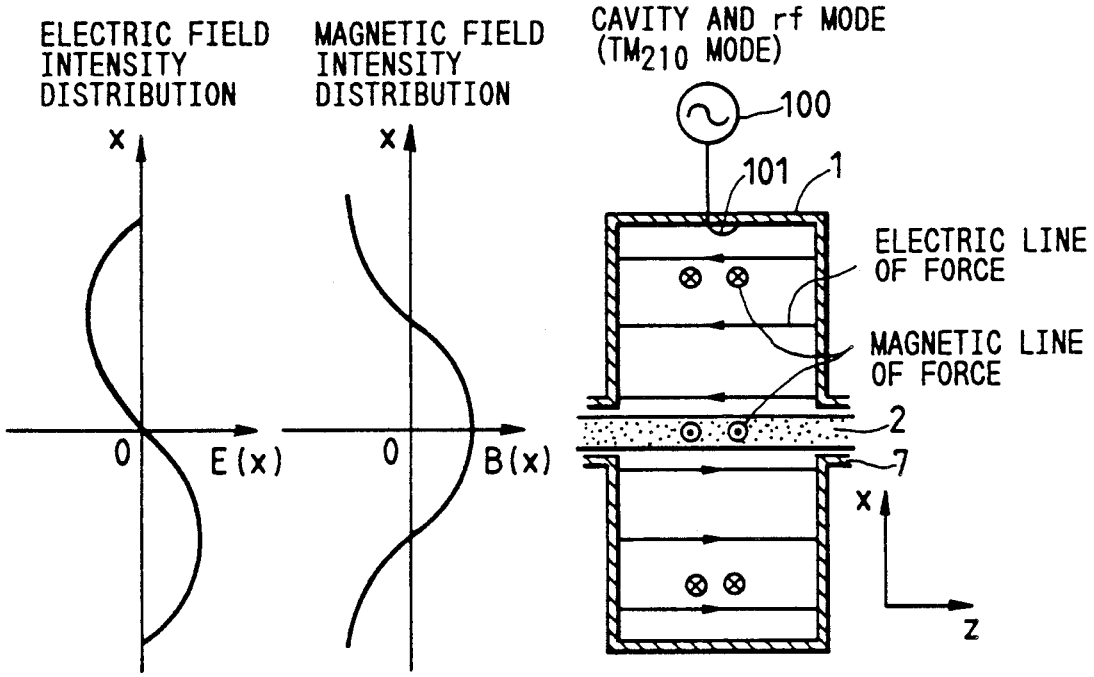
FIGS. 6(*a*)–(*d*) are diagrams showing the first embodiment of the present invention.
Figure 6D:
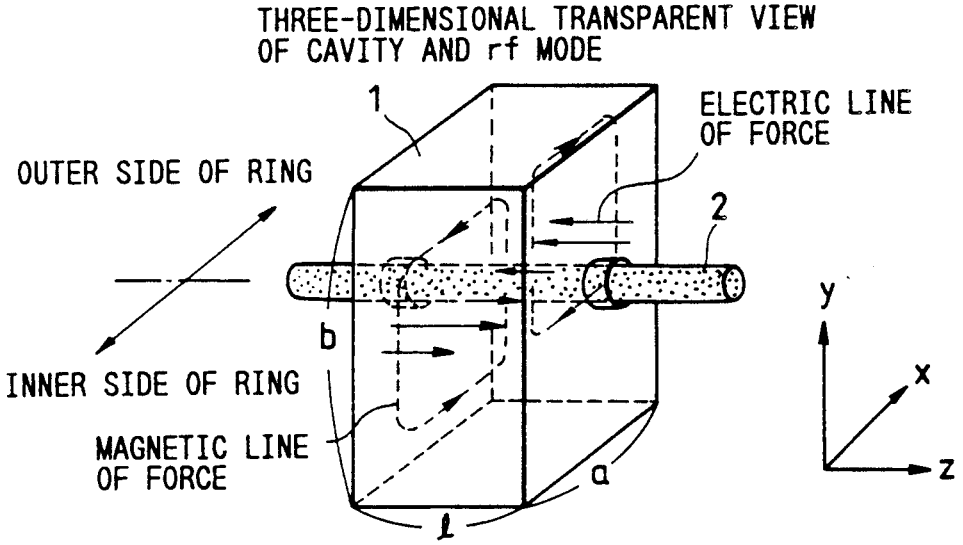

Now, the first embodiment of the present invention will be described with reference to FIGS. 6(*a*)–(*d*). In the ring-shaped accelerator as shown in FIG. 2, a cavity 1 in the shape of a rectangular parallelepiped as shown in FIG. 6 is installed on the particle orbit 10 separately from the rf accelerating cavity 4, so as to pass the particle beam 2 inside the cavity 1. As illustrated in the drawing, rectangular coordinate axes x, and y and z are taken, and an x-z plane is set as the plane of the orbit of the particle beam, a z-direction as the traveling direction of the particle beam an x-direction as the outer direction of the ring relative to the particle beam, and a y-direction as a direction perpendicular to the plane of the particle beam orbit. The center axis of the cavity 1 is determined so as to agree with the closed orbit (central orbit) corresponding to the center energy of the particle beam 2.

Figure 7:
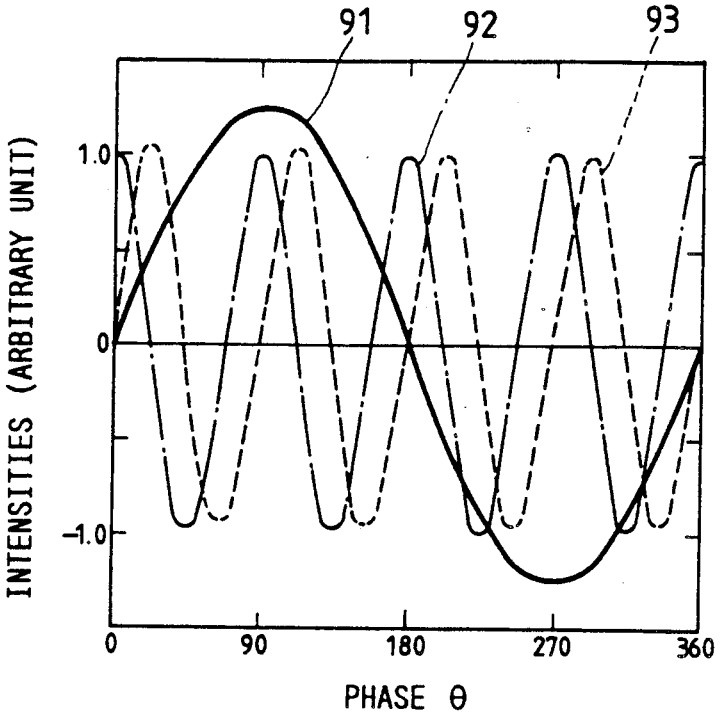
FIG. 7 is a diagram showing the phasic relationship between a rf electric field intensity and a rf magnetic field intensity.

A microwave is injected from an external oscillator 100 into the cavity 1 through a coupled antenna 101, and a rf electromagnetic field of $TM_{210}$ mode is established in the cavity 1 as shown in the drawing. The resonant frequency of the electromagnetic field oscillations is set at integral times (m times) the acceleration frequency of the particles (the resonant frequency of the fundamental acceleration mode of the rf accelerating cavity 4). On this occasion, the relative phases of the electromagnetic modes of both the cavities are set as shown in FIG. 7. In FIG. 7, numeral 91 indicates the rf electric field intensity within the rf accelerating cavity 4, numeral 92 the rf electric field intensity within the cavity 1, and numeral 93 the rf magnetic field intensity in the cavity 1. In terms of formulas, the following holds:

$$V_1 = V_{1o}\sin\theta \tag{2}$$

$$V_2 = V_{2o}\cos(m\theta) \tag{3}$$

Here, $V_1$: voltage within the rf accelerating cavity 4, $V_2$: voltage in the cavity 1, $\theta$: rf phase, $V_{1o}$: amplitude value of $V_1$, $V_{2o}$: amplitude value of 2.

At this time, the particles induce the intense synchrobetatron resonance as stated before, and the transverse beam size lessens.

Here, the integer m is determined from the viewpoint of the size of the cavity 1 coming from the resonant frequency of the deflection mode in the cavity. Usually, the resonant frequencies of rf accelerating cavities are broadly classified into a 100 MHz-band and a 500 MHz-band m=4–5 is set for the 100 MHz-band, and m=1 is set for the 500 MHz-band, whereby the resonant frequency of the deflection mode in the cavity 1 is adjusted to or near 500 MHz. Thus, the cavity 1 becomes a size suited to the accelerator. The size will be concretely estimated. The electromagnetic resonance mode in the cavity 1 shall be approximated by one in the absence of the beam duct 7. In FIG. 6(*d*), the lengths of the cavity in the x-, y- and z-directions are let be a, b and l, respectively. Then, the resonant frequency $f_{rl}$ of the $TM_{210}$ mode being the electromagnetic resonance mode on this occasion can be expressed as:

$$f_{rl} = \frac{C}{2}\sqrt{\left(\frac{2}{a}\right)^2 + \left(\frac{1}{b}\right)^2} \tag{4}$$

Here, c denotes the velocity of light in vacuum. Assuming a=b, for example, a=b=67 cm holds for the resonant frequency $f_{rl}$=500 MHz, and these lengths are suitable. The dimension 1 of the cavity in the z-direction, namely, in the traveling direction of the particle beam 2 is not determined by the resonant frequency $f_{rl}$, and it can be properly determined considering other factors.

Meanwhile, the magnitude of the rf voltage V can be estimated as follows. Now, let's suppose the acceleration of the particles in which the energy (center energy) of the particles traveling along the central orbit is a low energy level of 10 MeV. The energy distribution of the bunch of particles is regarded as the Gaussian distribution, and the standard deviation $\sigma\epsilon$ thereof is assumed to be 1% of the center energy of 10 MeV, namely, to be 100 keV. Assuming the synchrotron tune $\nu$ (synchrotron oscillation frequency/circulating frequency of the particles) to be $5\times10^{-3}$ (in general, considerably smaller than 1), the rf voltage V around the particle beam 2 is, at most:

$$V \approx \nu\frac{\sigma_\epsilon}{e} = (5\times10^{-3})\times(100-10^3) = 500\ (V)$$

Here, e denotes the electric charge of the single particle. The maximum rf voltage $V_m$ in the cavity 1 can be estimated as:

$$V_m \approx \frac{a}{4r_b}V\ (r_b\text{: radius of the beam})$$

Therefore, assuming $r_b$=3 cm, the following holds by the use of a=67 cm:

$$V_m \approx \frac{67}{4\times3}\times500 = 2.8\ \text{kV}$$

Figure 3:
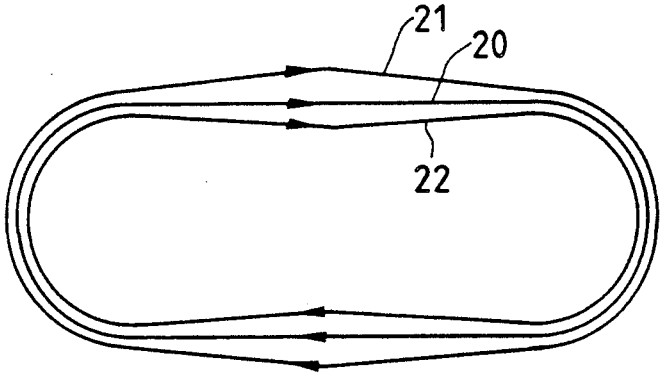
FIG. 3 is a diagram showing the situation of the closed orbits of charged particle beams in mode-like fashion.
Figure 4A:
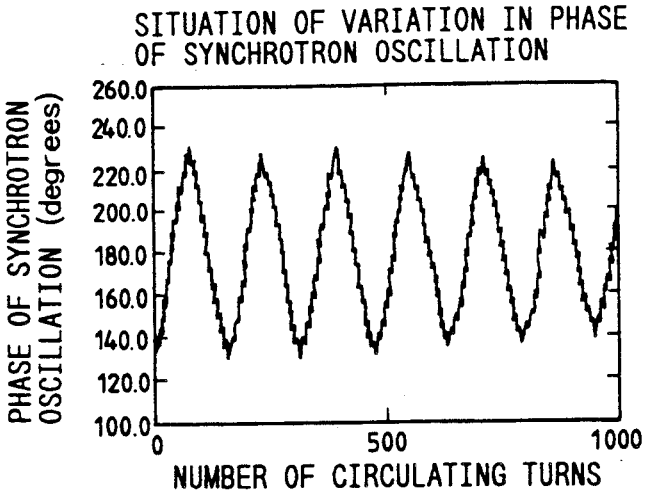
FIGS. 4(*a*)–(*d*) are diagrams of an analyzed example showing the concrete effect of the present invention.
Figure 4B:
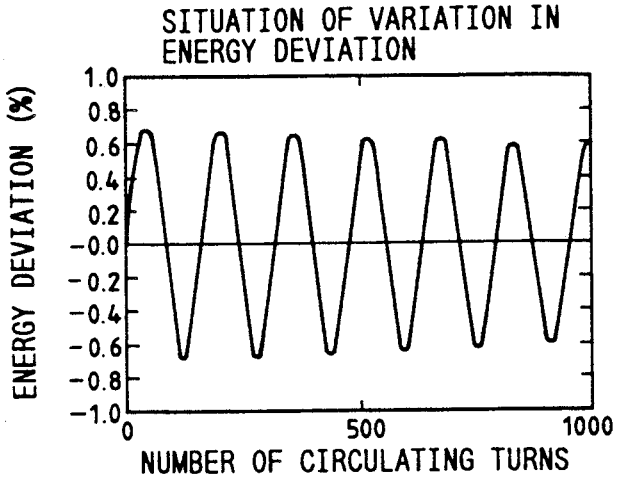
Figure 4C:
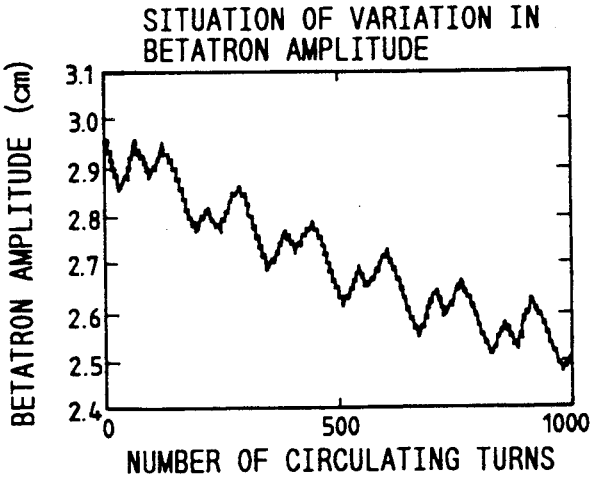
Figure 4D:
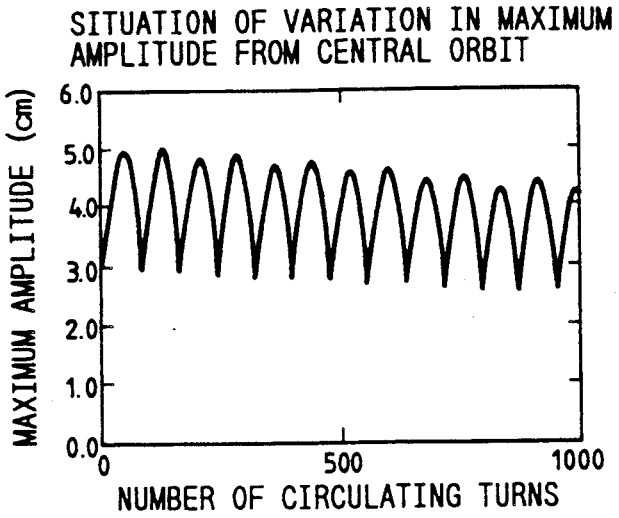

By the way, in the analyzed example of FIG. 3, $V_m$=−1.0 kV holds for the rf accelerating voltage $V_{1o}$=5 kV and the synchrotron tune $\nu=3.6\times10^{-3}$. When this voltage value is applied to the Kilpatrick formula of electric discharge limitation, electric discharge take place for 1{0.05 mm, and the electric discharge is not apprehended as long as the cavity is fabricated with 1 set in the order of 1 cm.

According to this embodiment, the cavity whose dimensions a and b are about 70 cm and whose dimension 1 is several cm suffices, and a radiant light apparatus can be held compact.

The second embodiment of the present invention will be described with reference to FIGS. 8(*a*)–(*d*). Incidentally, FIGS. 8(*a*)–(*b*) show the intensity distributions of an electric field and a magnetic field on an A—A′ plane in FIG. 8(*c*), respectively. This embodiment is such that a cavity 11 in the shape of a cylinder is employed instead of the cavity 1 in the first embodiment, and that the particle beam is passed penetrating the side wall of the cylindrical cavity. Coordinate axes are taken in the same way as in the foregoing, and the cylinder axis of the cavity 11 is brought into agreement with the z-direction. A microwave is injected from an external oscillator 100 into the cavity 11 through a coupled antenna 101, whereby a rf electromagnetic field of $TE_{011}$ mode is established in the cavity 11 as illustrated in the drawing. Here, the resonant frequency $f_{r2}$ of the electromagnetic field oscillations of the $TE_{011}$ mode is set at integral times the acceleration frequency of the particles. The phase relations with the rf accelerating voltage conform for Eqs. (2) and (3) mentioned before. Also with this embodiment, the same functional effects as stated in the first embodiment are achieved.

Also here, the dimensions of the cavity 11 and the rf electric field intensity as required will be concretely estimated.

Figures 8A, 8B, 8C:
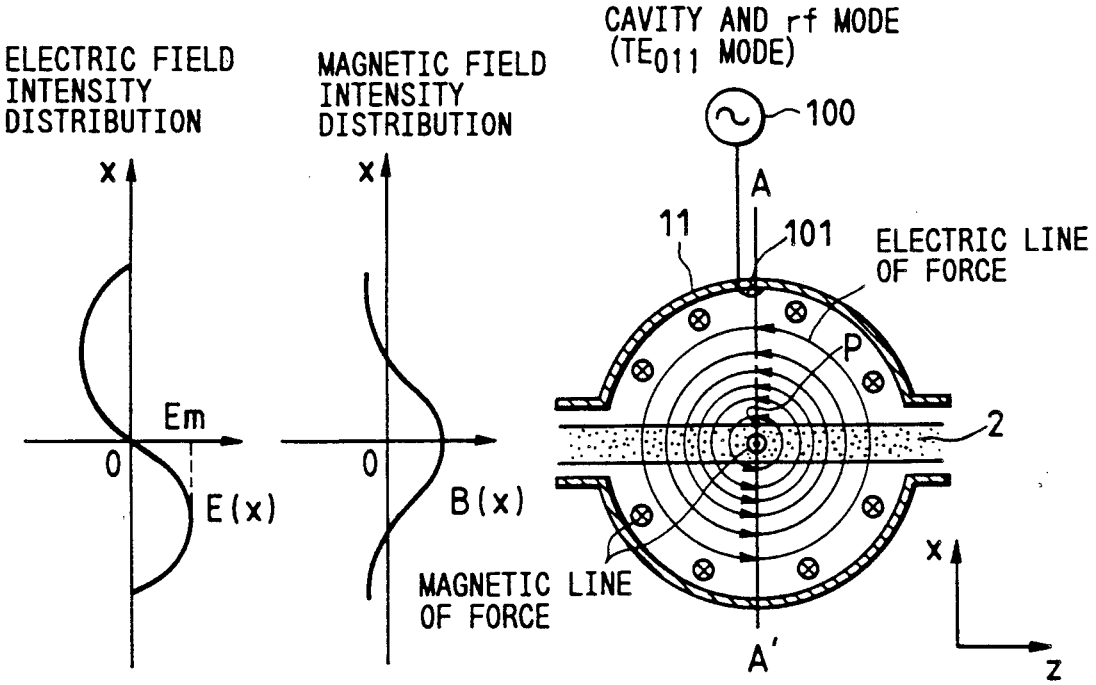
FIGS. 8(*a*)–(*d*) are diagrams showing the second embodiment.
Figure 8D:
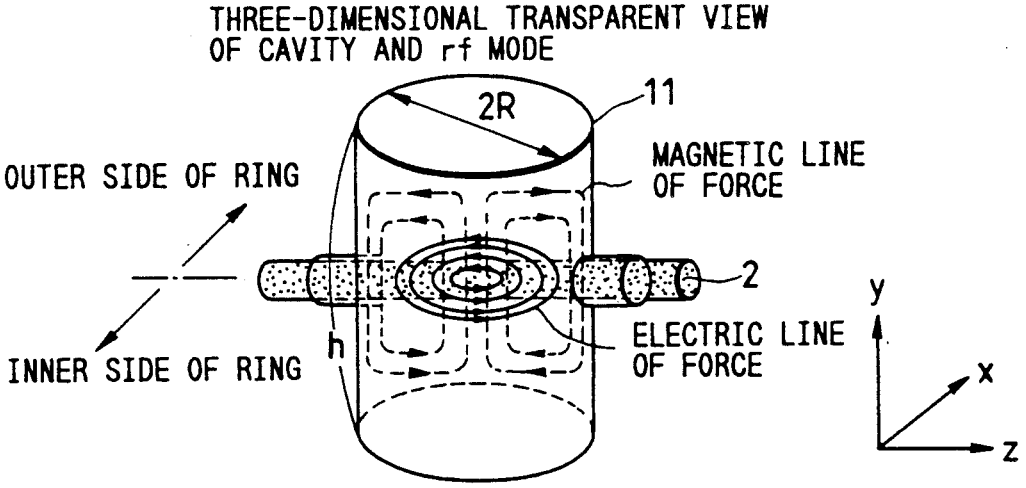

The radius of the cylindrical cavity 11 is denoted by R, and the height thereof by *h* (refer to FIG. 8(*d*)). The resonant frequency $f_{r2}$ of the $TE_{011}$ mode in the cavity 11 can be approximately expressed as:

$$f_{r2} = \frac{c}{2}\sqrt{\left(\frac{j_{01}}{\pi R}\right)^2 + \frac{1}{h^2}}$$

Here, $j_{01}$ indicates the first zero point of the derivative of the Bessel function of order O.

Assuming $f_{r2}=500$ MHz and $2R=h$ by way of example, $j_{01}=3.83$ is obtained, and hence, $h=2R=79$ cm holds, so that no problem exists in realizability.

The required rf electric field intensity becomes as follows: When the value of the intensity at a point P in FIG. 8(*c*) is denoted by $E_b$ and the effective distance of an electric field acting in the traveling direction of the particle beam 2 is supposed nearly equal to the radius $r_b$ of the particle beam 2, the rf voltage V is:

$$V \approx E_b r_b \approx 500 \text{ (V)}$$

Accordingly, $Eb \approx 17$ kV/m is conjectured subject to $r_b = 3$ cm. The peak value $E_m$ of the electric field intensity in FIG. 8(*a*) is:

$$E_m \approx \frac{R}{2r_b} E_b = 110 \text{ (kV/m)}$$

which is a sufficiently realizable numerical value. Since, in this case, the electric field on the wall surface of the cavity is zero, the electric discharge is not apprehended at all.

Figures 9A, 9B, 9C:
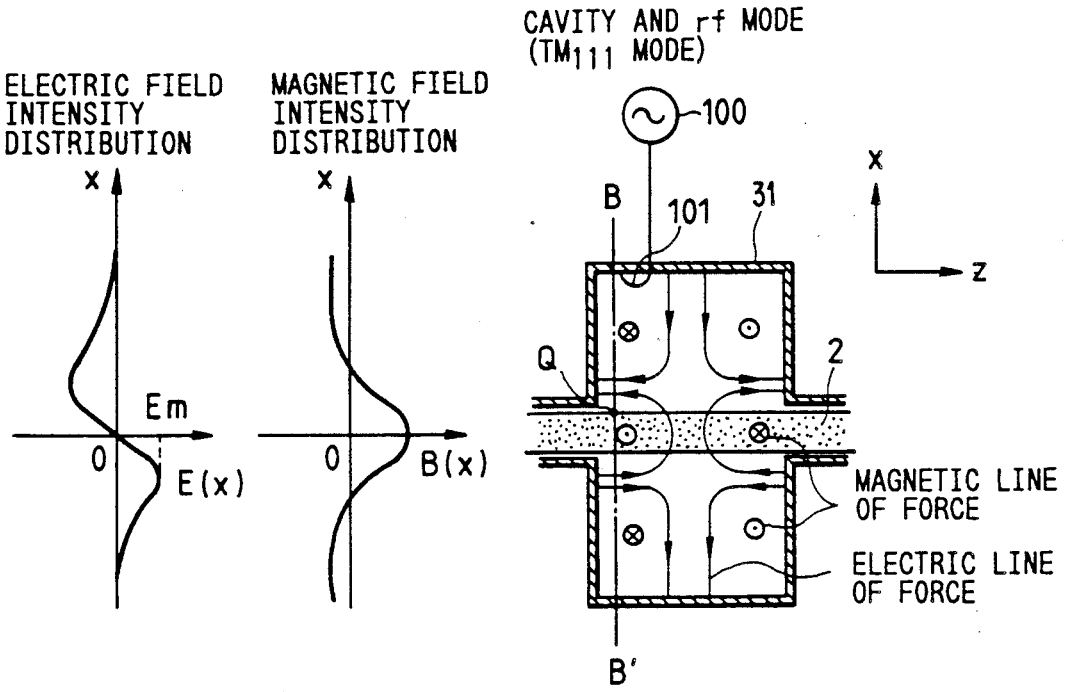
FIGS. 9(*a*)–(*d*) are diagrams showing the third embodiment.
Figure 9D:
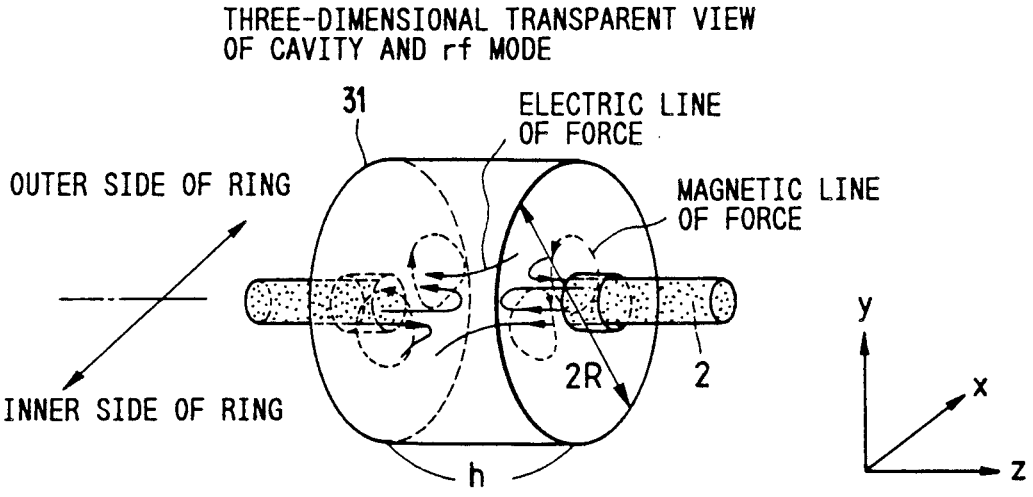

Lastly, the third embodiment will be described with reference to FIGS. 9(*a*)-(*c*). Incidentally, FIGS. 9(*a*)-(*b*) show the intensity distributions of an electric field and a magnetic field on a B—B′ plane in FIG. 9(*c*), respectively. This embodiment is such that, as illustrated in FIG. 9(*c*), a cavity 31 in the shape of a cylinder is located so as to be penetrated by the particle beam 2, and that the orbital axis of the center energy of the particle beam 2 is held in agreement with the center axis of the cavity 31. Coordinate axes are taken in the same way as in the foregoing. A microwave is injected from an external oscillator 100 into the cavity 31 through a coupled antenna 101, whereby a rf electromagnetic field of $TM_{111}$ mode is established in the cavity 31. Also here, the resonant frequency $f_{r3}$ of the electromagnetic field oscillations of the $TM_{111}$ mode is set at integral times the acceleration frequency of the particles. The phase relations with the rf accelerating voltage conform to Eqs. (2) and (3) mentioned before. Also with this embodiment, the same functional effects as stated in the first embodiment are achieved.

Also here, the dimensions of the cavity 31 and the rf electric field intensity as required will be confretely estimated.

The radius of the cylindrical cavity 31 is denoted by R, and length thereof by *h* (refer to FIG. 9(*d*)). The resonant frequency $f_{r3}$ of the electromagnetic field oscillations of the $TM_{111}$ mode can be expressed as:

$$f_{r3} = \frac{c}{2}\sqrt{\left(\frac{j_{11}}{\pi R}\right)^2 + \frac{1}{h^2}}$$

Here, $j_{11}$ indicates the first zero point of the derivative of the Bessel function of order 1. Assuming $f_{r3}=500$ MHz and $2R=h$ by way of example, $j_{11}=3.83$ is obtained, and hence, $h=2R=79$ cm holds, so that no problem in realizability exists as in the second embodiment.

The required rf electric field intensity becomes as follows: When the value of the intensity at a point Q in FIG. 9(*c*) is denoted by $E_b$, the effective distance of an electric field acting in the traveling direction of the particle beam 2 is h/2 or so, and hence, the rf voltage V is:

$$V \approx E_b \frac{h}{2} \approx 500 \text{ (V)}$$

Accordingly, $E_b \approx 1.3$ kV/m is conjectured subject to $h = 79$ cm. The peak value $E_m$ of the electric field intensity in FIG. 9(*a*) is:

$$E_m \approx 2E_b \approx 2.6 \text{ kV/m}$$

which is also a sufficiently realizable numerical value, and the electric discharge is not apprehended.

According to the present invention, the transverse beam size of a particle beam entered into a ring-shaped accelerator can be lessened to about 1/10 of the transverse beam size in the prior art, and hence, a transverse wake field weakens, the beam is restrained from becoming unstable, and the loss of the beam is reduced, whereby the particle beam of low energy and large current is permitted to be injected, accelerated and stored. Thus, a beam injector may be simple, and the whole synchrotron radiation sources for industrial use can be made smaller in size.

Moreover, according to the present invention, many times of injections at low energy as have heretofore been impossible become possible, and a large current injection is facilitated.

What is claimed is:

1. In a ring-shaped charged particle accelerator having a vacuum vessel in which a charged particle beam is confined, and which includes therein bending magnets for deflecting the charge particle beam and forming a closed orbit of charged particles, focusing magnets for focusing the charged particle beam, and a rf accelerating cavity for accelerating the charged particles;

a charged particle accelerator comprising:

a cavity which is separate from said rf accelerating cavity, and means for exciting a rf electromagnetic field in said cavity separate from said rf accelerating cavity, in such a manner that the rf electromagnetic field is established in a deflection mode which has electric field components in a direction of a central orbit of the charged particles and in which a magnetic field in a direction perpendicular to a plane of the central orbit develops on the central orbit of the charged particles, that a resonant frequency of the deflection mode is set at integral times a resonant frequency of a fundamental rf mode in said rf accelerating cavity, and that a phase relationship between high frequencies of said rf accelerating cavity and said cavity separate therefrom is so held that, when a rf electric field intensity of said rf accelerating cavity has a phase of zero, a rf magnetic field intensity of said cavity separate from said rf accelerating cavity rises in phase.

2. A charged particle accelerator according to claim 1, wherein said cavity separate from said rf cavity is a cavity in the shape of a rectangular parallelepiped which has edges perpendicular to the plane of the central orbit of the charged particles.

3. A charged particle accelerator according to claim 1, wherein said cavity separate from said rf accelerating cavity is a cavity in the shape of a cylinder which has its center axis in the direction perpendicular to the plane of the central orbit of the charged particles.

4. A charged particle accelerator according to claim 1, wherein said cavity separate from said rf cavity is a cavity in the shape of a cylinder which has its center axis in the direction of the central orbit of the charged particles.

5. A method of cooling a charged particle beam in a ring-shaped charged particle accelerator wherein charged particles are accelerated by a rf accelerating cavity; characterized in that a cavity separate from said rf accelerating cavity, and means for exciting a rf electromagnetic field in the separate cavity are provided, that a deflection mode which has electric field components in a direction of a central orbit of the charged particles and in which a magnetic field in a direction perpendicular to a plane of the central orbit develops on the central orbit of the charged particles is excited in a beam duct part of said separate cavity through which the charged particles pass, by the rf electromagnetic field excitation means, and that a resonant frequency of the deflection mode is set at integral times a resonant frequency of a fundamental rf mode in said rf accelerating cavity.

* * * * *